United States Patent [19]

Dodge et al.

[11] Patent Number: 4,867,211

[45] Date of Patent: Sep. 19, 1989

[54] OPEN SEA TRANSFER OF FLUIDS

[75] Inventors: John W. Dodge; Alan R. Rabett, both of Weybridge; Denis J. Mottram, Kingston, all of United Kingdom

[73] Assignee: British Aerospace Public Limited Company, London, England

[21] Appl. No.: 941,170

[22] Filed: Dec. 12, 1986

[30] Foreign Application Priority Data

Dec. 12, 1985 [GB] United Kingdom ..... 8530592

[51] Int. Cl.[4] ..... B67D 5/68; B67D 5/70

[52] U.S. Cl. ..... 141/279; 141/382; 141/383; 141/387; 441/4; 137/615; 901/15; 901/46

[58] Field of Search ..... 141/279, 387, 388, 1, 141/382–386; 441/4, 5; 414/137–139; 137/615, 899.2; 901/15, 16, 46, 47

[56] References Cited

U.S. PATENT DOCUMENTS

| | | | |
|---|---|---|---|
| 3,422,838 | 1/1969 | Headrick | 141/1 X |
| 3,515,179 | 6/1970 | Van Eek | 141/1 |
| 3,556,170 | 1/1971 | Bily | 141/1 |
| 3,583,445 | 6/1971 | Harbonn et al. | 141/1 |
| 3,595,278 | 7/1971 | Lilly, Jr. et al. | 141/1 |
| 3,690,887 | 7/1971 | Quase | 141/1 |
| 4,273,066 | 6/1981 | Anderson | 141/387 |
| 4,402,350 | 9/1983 | Ehret et al. | 141/279 |
| 4,530,302 | 7/1985 | Pedersen | 141/387 |
| 4,625,746 | 12/1986 | Calvin et al. | 137/86.1 |
| 4,645,467 | 2/1987 | Pollack | 141/387 |

FOREIGN PATENT DOCUMENTS 2177671 1/1987 United Kingdom .

*Primary Examiner*—Ernest G. Cusick

*Attorney, Agent, or Firm*—Cushman, Darby & Cushman

[57] ABSTRACT

The invention relates to equipment for the transfer for fluids, much as oil or gas, e.g. from a platform or buoy located by attachments to the sea bed, but otherwise with complete freedom of movement, due to the action of wind and wave, to a vessel with similarly complete freedom of movement. The equipment includes systems for automatically acquiring a target (10) to which is attached a tage line (11) and a transfer hose line (9), and for automatically transporting that target (10) accurately to a winching system (16) mounted on the said ship. The transfer hose line can be reeled in by the winching system (16) and the fluid transfer hose thus connected automatically to the ship-mounted receiving system. The equipment includes a self-sealing fluid coupling through which fluid flow can take place, and a hose having sufficient length to accommodate the stand-off of the vessel from the platform or buoy. Routine uncoupling is accomplished by reversing the coupling procedure, including the use of the same equipment to replace the target in close proximity to the buoy in a controlled manner. The mechanical configuration of the deck equipment 16 is such that if an emergency occurs, the transfer hose line and the running shackle can be released from their respective clamps (43)(44), thus permitting the transport hose line to pay-out. This would allow all the equipment connecting the receiver vessel with the buoy or platform to fall overboard in a predetermined manner. This procedure maintains the continuous loop which comprises the transfer hose, transfer hose line and tag line, and enables a pick-up to be effected subsequently.

9 Claims, 11 Drawing Sheets

OPEN SEA TRANSFER OF FLUIDS

FIELD OF THE INVENTION

This invention is concerned with the transfer of fluids from a moored or anchored oil or gas platform, vessel, buoy or wellhead subject to wave action, to a receiver vessel in open-sea conditions where there may be considerable relative movement between the platform and vessel in the heave, sway, surge, pitch, roll and yaw senses.

BACKGROUND OF THE INVENTION

In known arrangements a receiver vessel is manoeuvred alongside the buoy or platform and the fluid transfer hose passed from one to the other. This may be a hazardous and difficult operation in an open sea particularly in the extreme climatic conditions which frequently prevail. Although the hose transfer may be effected by use of a picket boat, for example, as a shuttle or messenger between buoy or platform and the receiving ship, this is a manual operation and crewmen may be at considerable risk. It is therefore highly desirable at least partly to automate the process of achieving fluid flow connection between the two.

One means of achieving this is described in our copending patent application 8518001 which teaches an arrangement for effecting such transfer at sea including interconnection means through which fluid flow can take place comprising a probe and a probe receiver being capable of engagement or disengagement to effect fluid transfer via a hose, one part of the interconnecting means being mounted upon the platform or buoy and the other part being carried by an at least partially space-stabilized gantry means, bow or stern mounted upon the receiver vessel. In that arrangement the receiver vessel can be temporarily placed in an engagement position adjacent to the platform and interconnecting parts automatically aligned to effect engagement, the extendable hose being paid out as the vessel then moves away from the platform to a more convenient position, the interconnection means remaining engaged to allow fluid transfer.

SUMMARY OF THE INVENTION

It is the object of the present invention to provide yet a further arrangement which substantially automates the coupling sequence for achieving fluid flow interconnection between the hose and the receiving vessel, which allows the receiving vessel to maintain station alongside an unmanned supply platform or buoy during the period of achieving interconnection and subsequently throughout the fluid transfer and disconnect phases and which avoids the need for any manual handling of the transfer hose in any phase of the operation.

In accordance with this invention a system for effecting open-sea transfer of fluid from a source such as a moored or anchored oil or gas platform, vessel, buoy or wellhead, subject to wave action, to a receiver vessel in open-sea conditions includes, mounted on the receiver vessel, an at least partially space-stabilized gantry means movable in both elevation and azimuth, target position sensing and acquisition means mounted on the gantry means, clamping means, winding means, and a first self sealing part of an interconnection means, and, mounted on the source, hose means for the transfer of fluid from the source, a second self sealing part of the interconnection means at an end of the hose means remote from the source for automatically mating with the first part of the interconnection means to form a continuous fluid path between the source and the receiver vessel, a transfer hose line secured to the hose means, a target device secured to an end of the transfer hose line remote from the hose means, and tag line means secured at one end to the target device and extendably secured at the other end to the source, whereby in use with the receiver vessel positioned adjacent the source, the target position sensing and acquisition means on the partially space-stabilized gantry means may be aligned with the target device, such that the target device may be acquired by the target position sensing and acquisition means, the gantry means may be actuated so as to cause automatic engagement between the target device and the clamping means and the winding means, the target device may be released from the gantry means, the clamping means may be disengaged and the winding means may draw in the transfer hose line and thereby the hose until the first and second parts of the interconnection means meet and automatically mate to provide the continuous fluid path therebetween and to couple the hose to the receiver vessel and whereby the hose may be uncoupled from the receiver vessel in a procedure substantially the reverse of the procedure described above for coupling the hose to the receiver vessel. Preferably, the gantry is slewably mounted upon the receiver vessel at a generally midships station and when not in use is arranged to fold down and is stowed parked to reduce windage since space stabilization is required only during active deployment for target acquisition and during part of the procedure for carrying the target aboard the receiver vessel.

Preferably, said hose means is carried in the buoy or platform in communication with a fluid supply source, said buoy including a jib structure from which the hose and the tag line separately depend in looped fashion, adequate tag line being housed within the buoy or platform, to allow appropriate extension when said target means is acquired and carried towards the receiver vessel by said gantry means.

The invention provides benefits, via automated procedures, in increased safety, repeatability, success of coupling and non-exposure of crew to weather and other hazards.

BRIEF DESCRIPTION OF THE DRAWINGS

One arrangement of the present invention will now be described, by way of example, with reference to the accompanying drawings in which.

DETAILED DESCRIPTION OF A PREFERRED EMBODIMENT OF THE INVENTION

Figure 1:
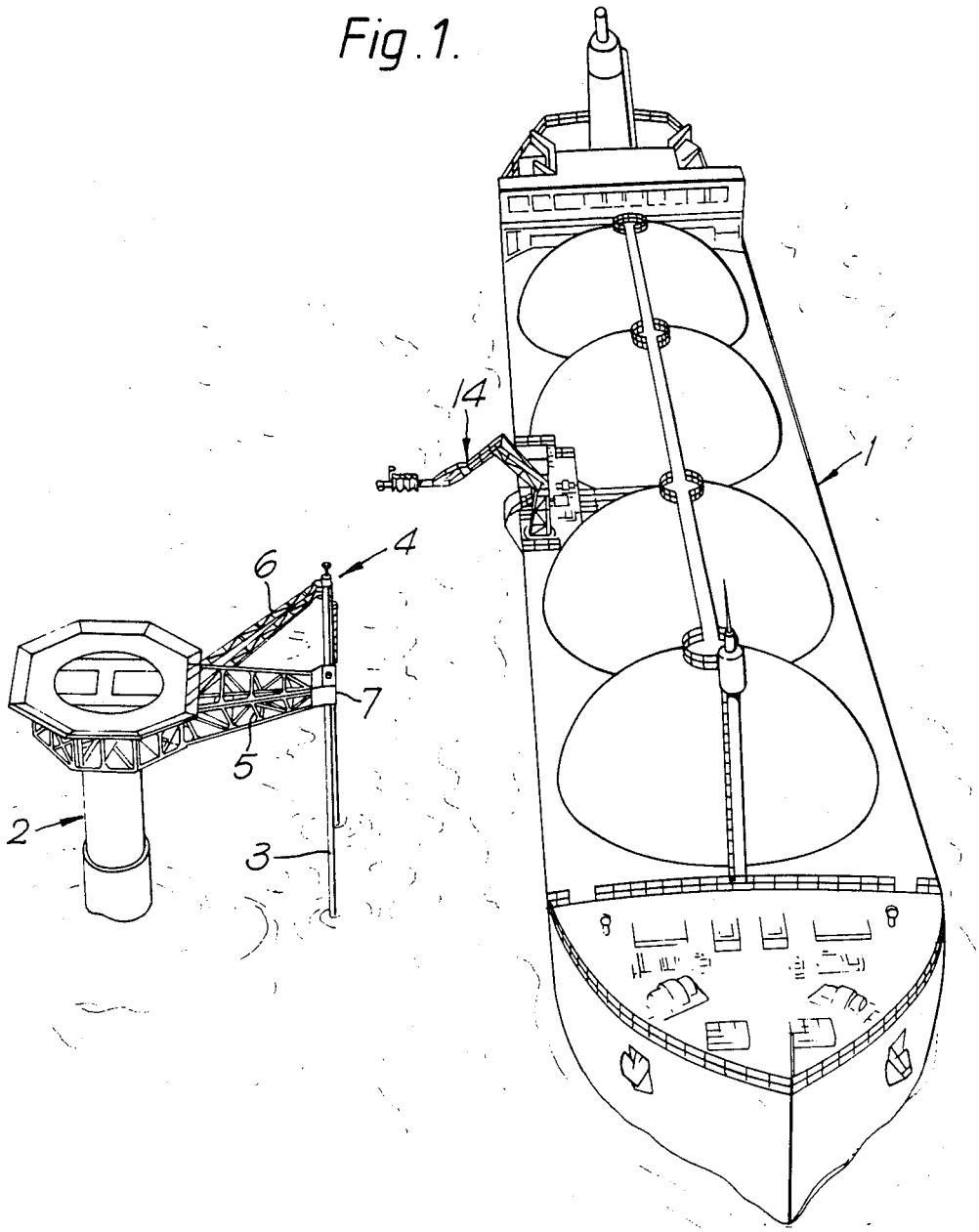
FIG. 1 is a pictorial illustration of a receiver vessel on station alongside a supply buoy.
Figure 2:
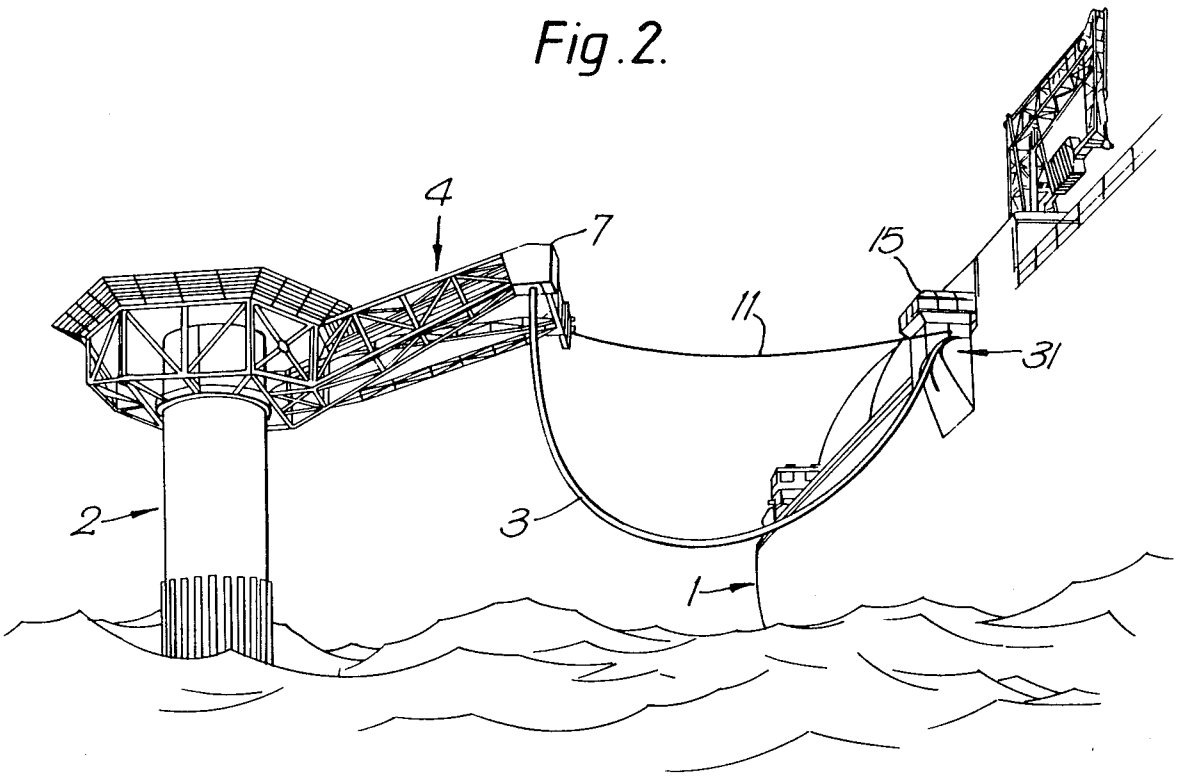
FIG. 2 is a further pictorial of a receiver vessel alongside a supply buoy during the fluid transfer phase.

Referring to the drawings FIGS. 1 and 2 show a liquefied natural gas (LNG) tanker vessel, hereinafter referred to as a receiver vessel 1, positioned alongside a supply buoy 2. Alternatively, the present invention can be (or is) equally applicable with the receiver vessel being directly coupled to a drilling platform or indeed to another vessel.

In the present and preferred arrangement the receiver vessel is maintained on station throughout the fluid transfer operation. The supply buoy 2 includes a jib assembly 4 comprising a primary jib arm 5 and a secondary jib arm 6, separated by a spacing member 12 (see FIG. 3).

Figure 3:
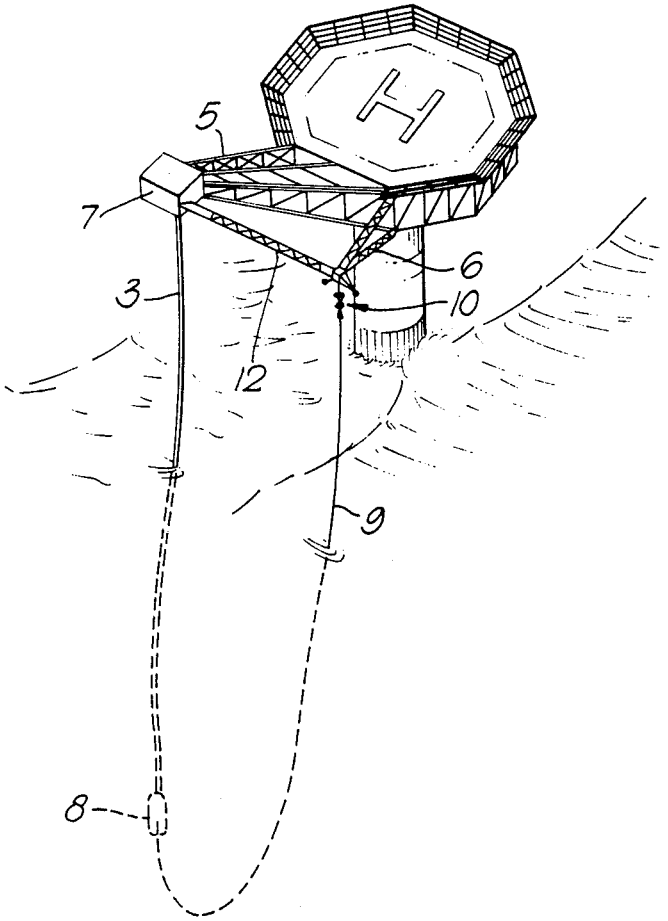
FIG. 3 illustrates the proposed buoy arrangement.
Figure 4:
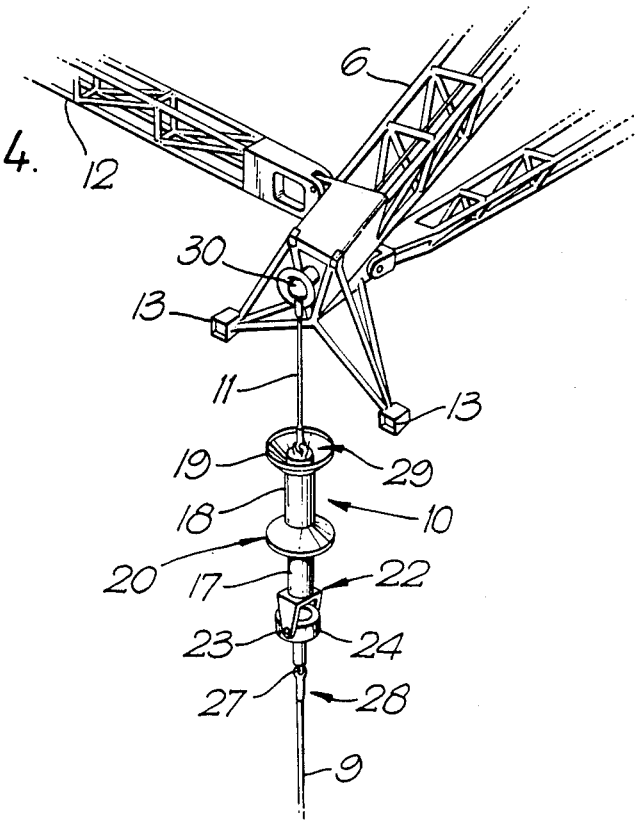
FIG. 4 is an elevation on the 'target' in accordance with the invention.
Figure 5:
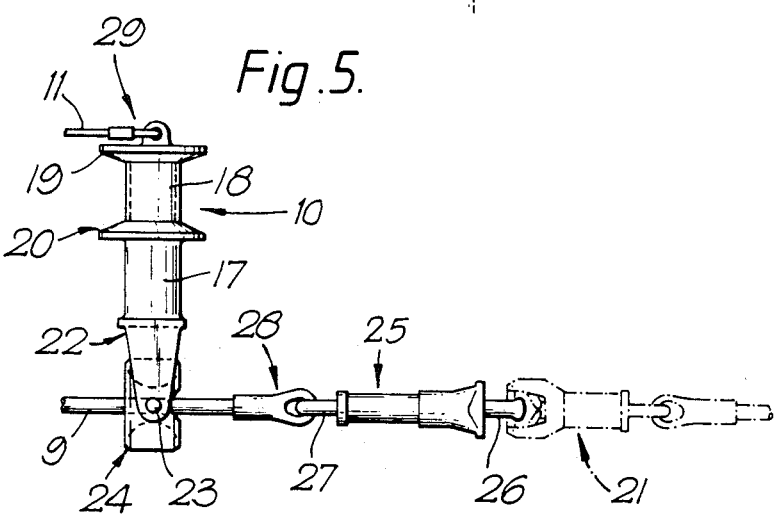
FIG. 5 illustrates the target and the running shackle and their relationship with the transfer hose line and coupling rod.

The hose 3 connected to the fluid supply (eg, oil or gas) within the buoy passes through the primary jib 5 and depends from the jib head 7. Since its length must be adequate to enable the receiver vessel 1 to maintain adequate separation with the buoy, typically 30 or more metres plus adequate surplus for engaging the fluid transfer means on the deck, when not in use the hose will be submerged for a considerable part of its length. At its submerged end the hose will include a self-sealing fluid coupling 8 (FIG. 3) and an attachment to a transfer hose line 9 which extends upwardly to terminate in a target 10 (FIGS. 3 and 4). This target 10 connects with a tag line 11 extending downwardly from the secondary jib arm 6, said tag line 11 passing along the secondary jib structure to terminate for example in a rotary storage drum (not shown) to enable additional tag line to be paid-out as will be later described. Target markers 13 are located at the extreme outboard end of the secondary jib 6 in a position which is fixed and known relative to the stowed target 10. As illustrated in FIGS. 4 and 5 the target 10 comprises a cylindrical shaft portion 17 contained within a concentric sleeve 18 having a pair of circular, tapered flanges 19 and 20 to form a bobbin type arrangement. The cylindrical shaft 17 extends downwards further to terminate in a tapered fork-fitting 22 having a pivotal connection 23 to a running shackle 24. This shackle 24 includes a bore having upper and lower edges of large cross-sectional radius to enable the shackle to function as a fairlead, at a stage to be described. Inserted into the shackle 24 and engaged thereby is a coupling rod 25 including a ball-end 26 and a lug 27 which provides a pivotal attachment 28 to the transfer hose line 9. An eye at the upper end of the cylindrical shaft 17 provides a pivotal attachment 29 to the tag line 11, said tag line including a stop 30 located at a fixed distance from the tag line end to ensure a consistent location of the target 10 below the jib 6.

Figure 6:
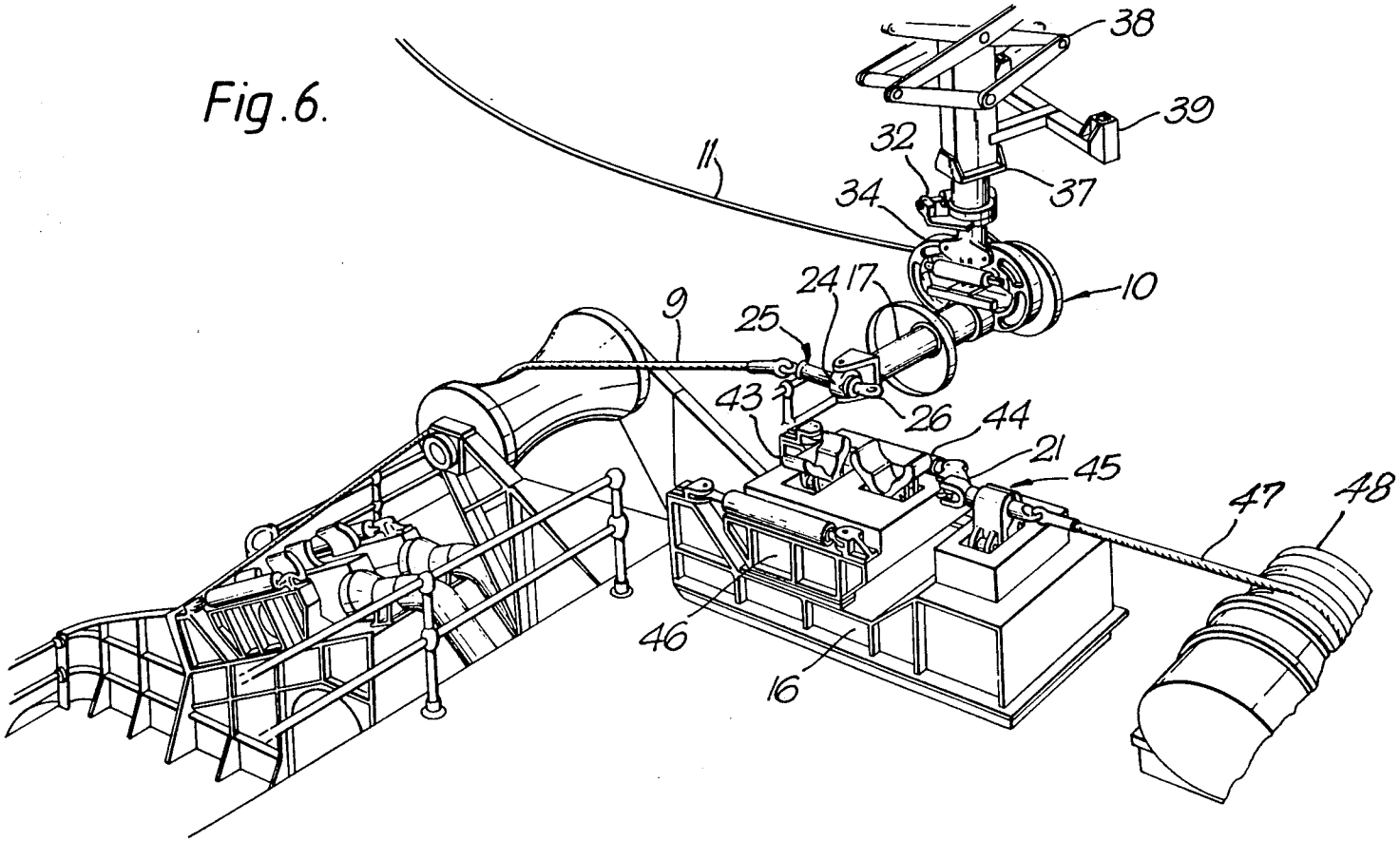
FIG. 6 is a pictorial view on the receiver vessel deck illustrating the placement of the 'target' on to the hose winching equipment.

At a mid-ship position, the receiver vessel 1 includes an automatically space-stabilized gantry 14, an observation cabin 15 located adjacent to it and locating and winching equipment 16 (see FIG. 6). The vessel is modified at the mid-ship position to incorporate a guide-way 31 to accommodate the hose 3 when it is winched aboard into position by means of the transfer hose line 9. Depending on sea conditions the receiver vessel and the supply buoy may move in a relative sense to each other. They may each move bodily vertically (i.e. heave), laterally (i.e. sway) and longitudinally (i.e. surge) in the same or opposing senses and may also move angularly about pitch, roll and yaw axes, although yaw and pitch effects will be beneficially reduced by virture of the mid-ships installation.

Figure 7:
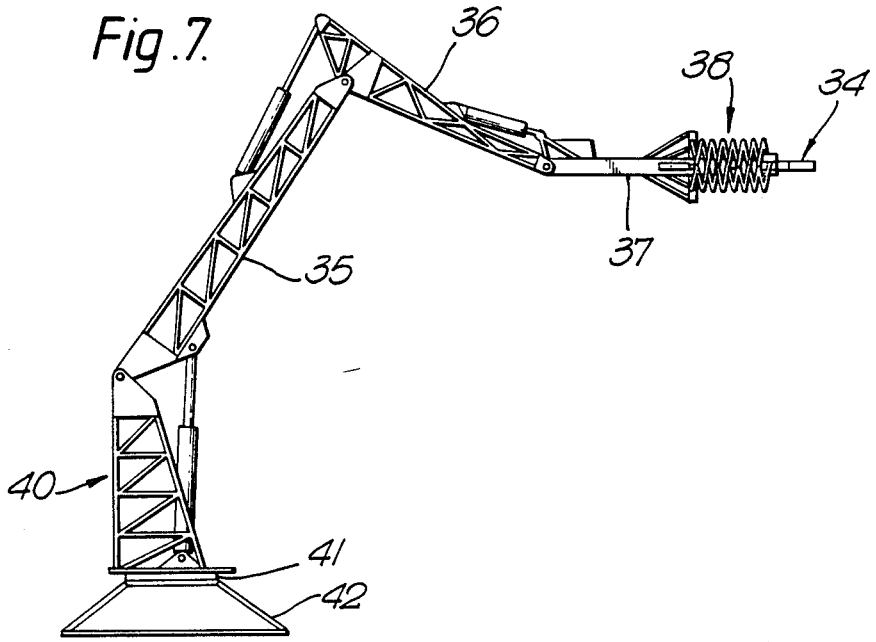
FIG. 7 is pictorial illustration of a space stabilized gantry in accordance with the invention.
Figure 8:
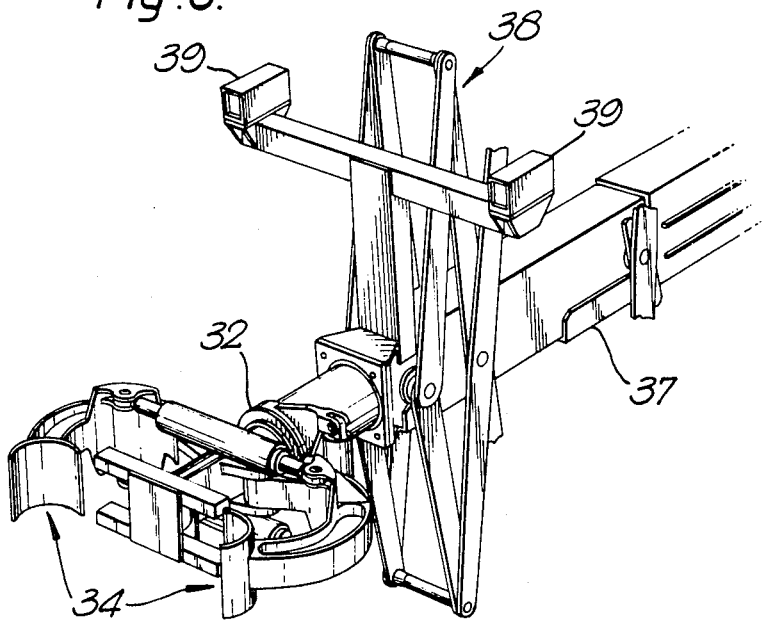
FIG. 8 is a pictorial illustration of the end of the gantry showing the arrangement of the caliper and rotary joint and their disposition in relation to the sensing devices.

The gantry 14, which will be known by British Aerospace trade mark "Skydrant", as shown in one form thereof in FIG. 7, comprises four main sections, three of which are independently moveable in elevation with respect to the others. One of the sections is a support tower 40 mounted for controlled azimuthal movement on a slewing ring 41 anchored to the deck 42 adjacent the side rail 33 (see FIG. 9*a*) of the receiver 1. The remaining sections comprise inner 35, center 36 and outer 37 booms each movable with respect to each other by known means eg hydraulic means. The boom 37 may also be extended in length and it carries a targe engaging caliper 34 at its end on a rotary joint 32.

The gantry is thus articulated and so arranged that its remote end, that is the target engaging caliper 34, is at least partially space stabilized, the various movements to this articulation being effected by controlled movement of the respective gantry portions 35, 36 and 37. Additional movement in the gantry extension sense may be obtained by means of the device 38 to accommodate differential lateral movement between the buoy and vessel for example by a lazy tongs mechanism. The caliper 34 includes articulation means to provide a rotary movement. The articulation of gantry 14 provides the necessary response enabling it to move the minimized mass accurately over a long distance at a high rate.

Figure 9A:
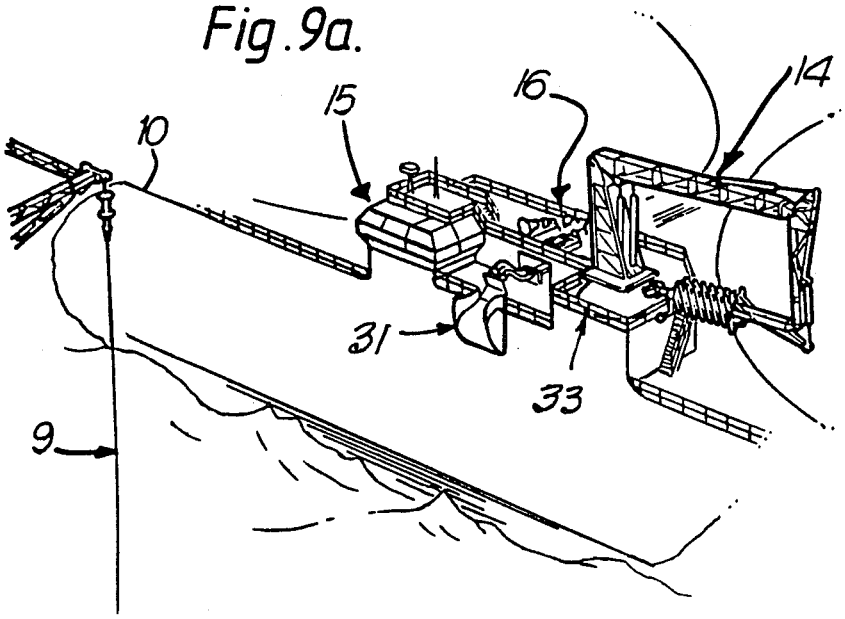
FIG. 9*a* through 9*h*, 9*j* and 9*k* depict a sequence of operations during the target capture and interconnection phase.

Remote sensing devices 39, for example television cameras, are mounted on the outer boom 37 and provide the information required for automatic capture of the target. With the gantry deployed as indicated in FIG. 9*d* and with the control system recognizing the target 10, depending from the tag line at a predetermined and fixed height below the jib arm 6, a positive capture lock is effected between the caliper 34 and the target bobbin cylindrical sleeve 18.

Figure 9B:
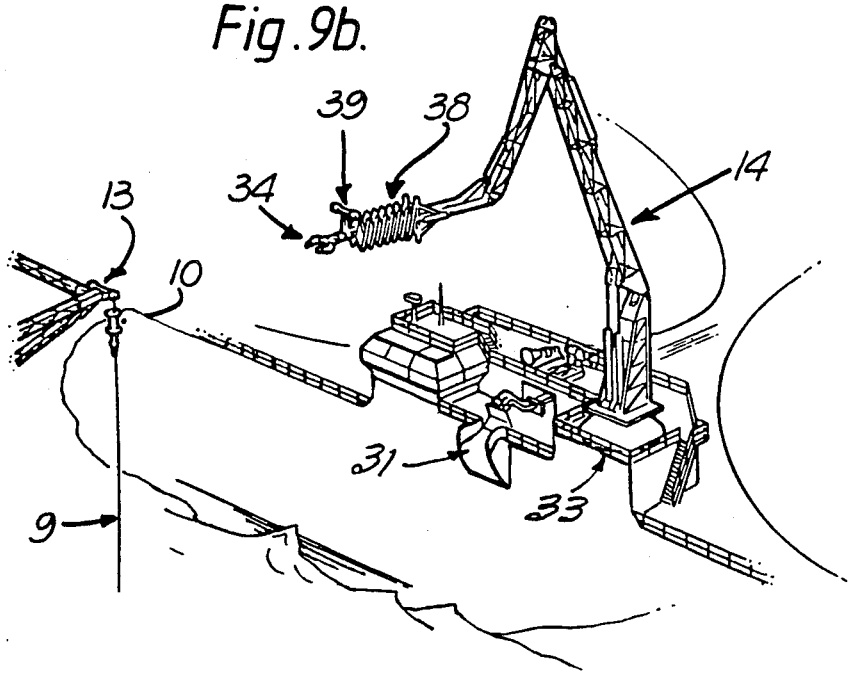
Figure 9C:
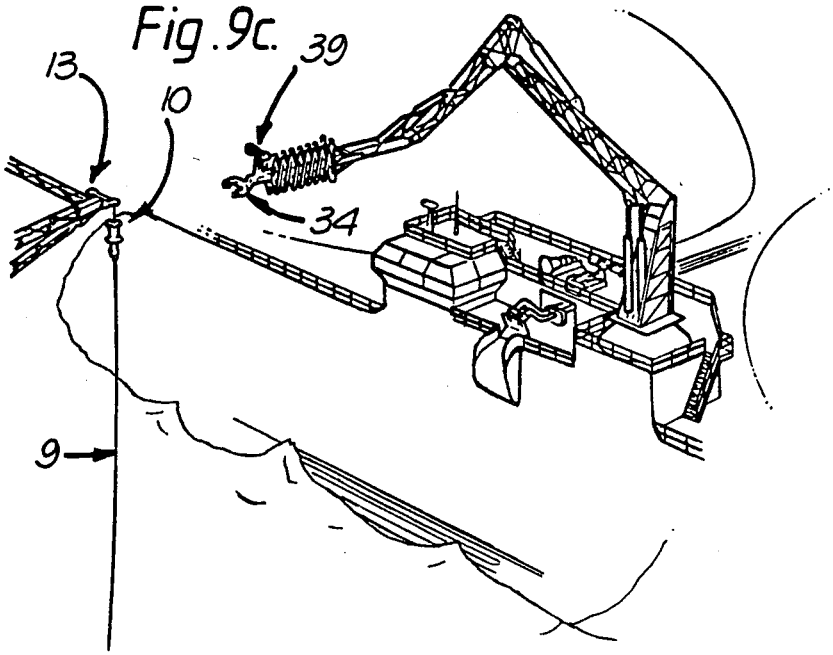
Figure 9D:
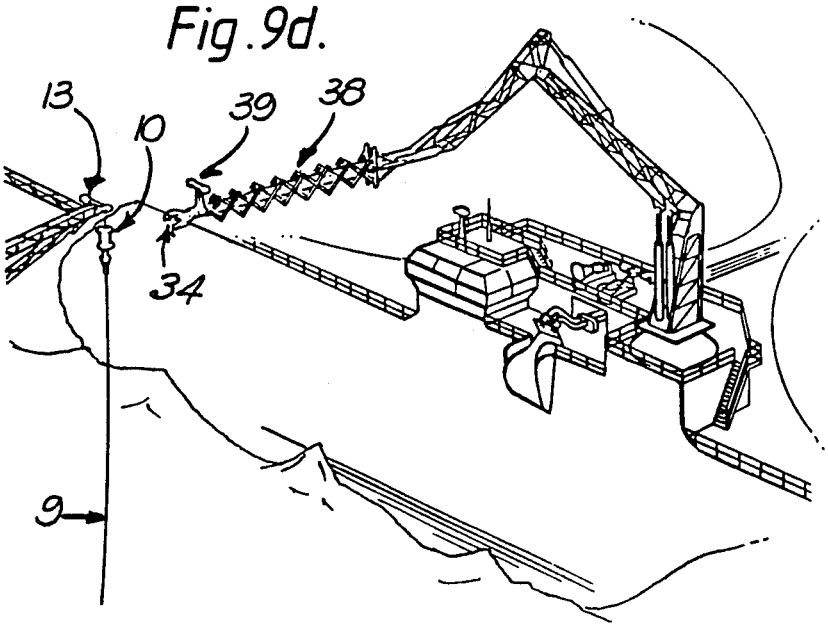
Figure 9E:
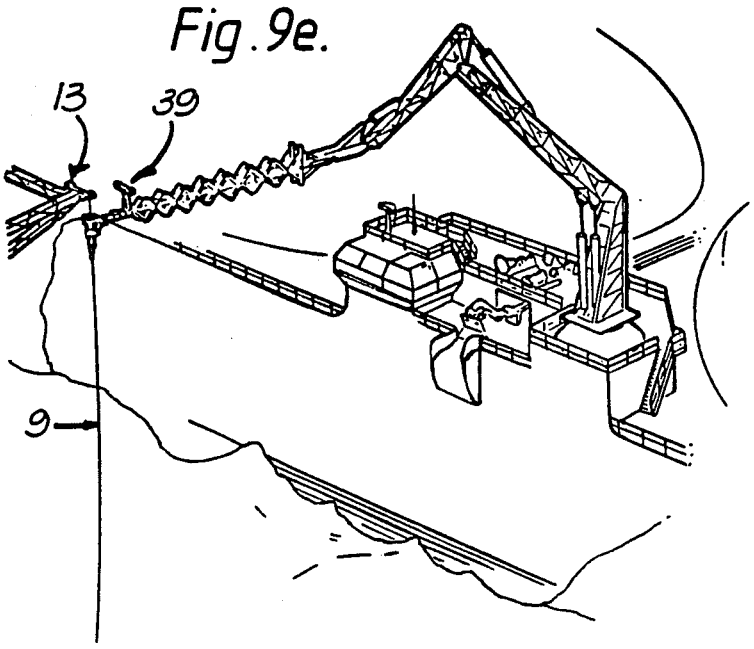
Figure 9F:
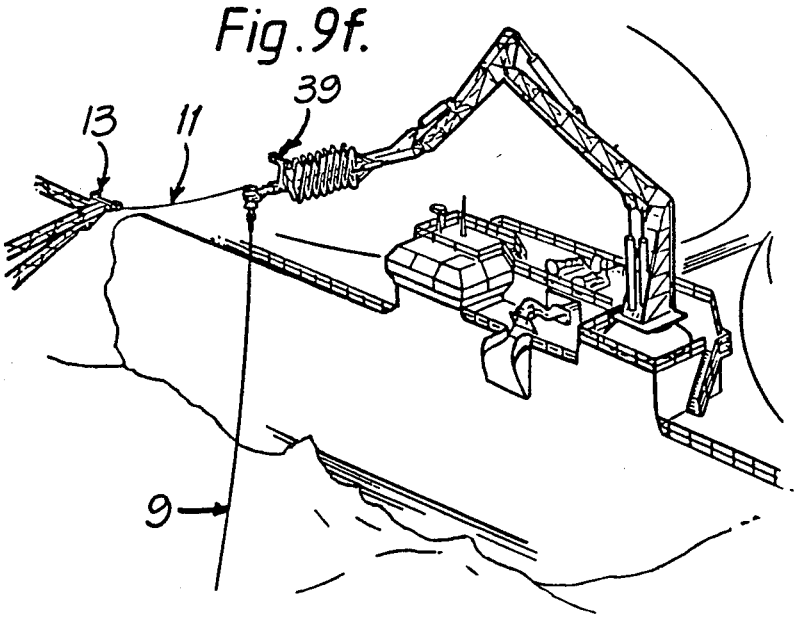
Figure 9G:
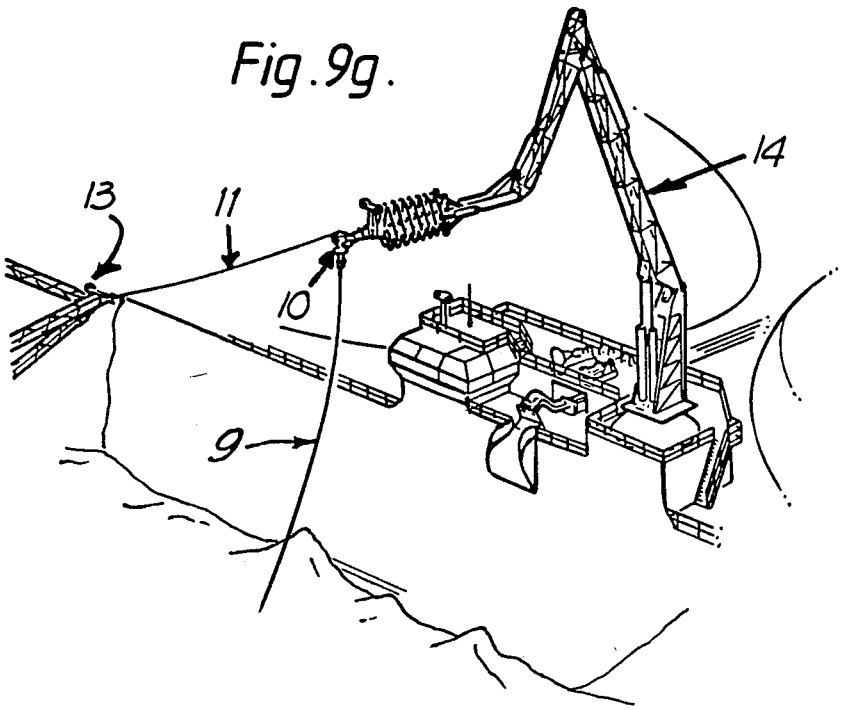
Figure 9H:
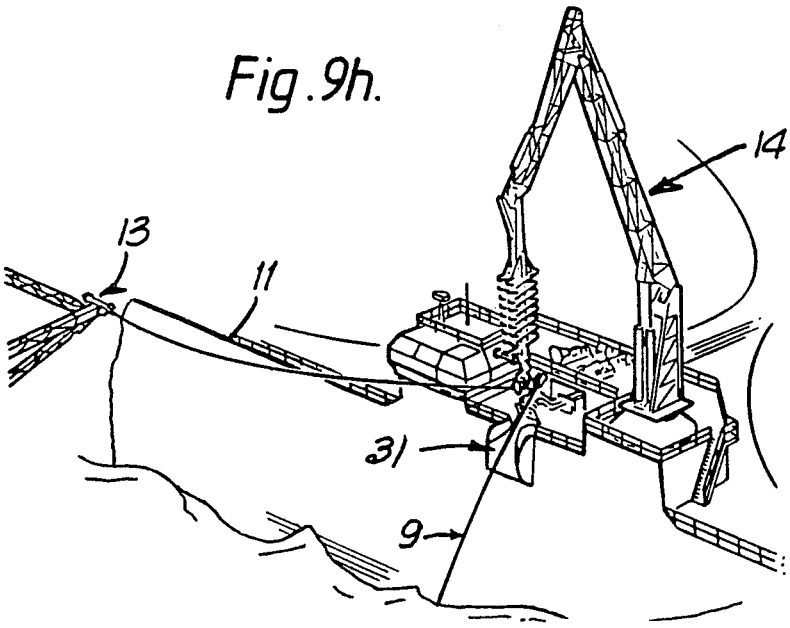
Figure 9J:
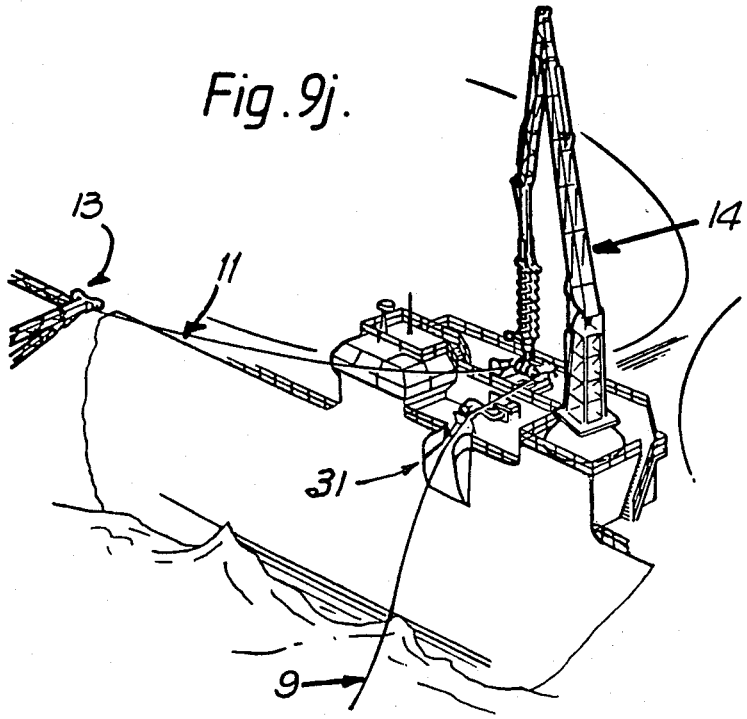

FIG. 9*e* indicates such capture whilst FIG. 9*g* illustrates the gantry 14 being articulated to draw the target 10 towards the receiving vessel 1, the tag line 11 being paid out from the buoy. At this stage, the gantry articulation is being automatically reprogrammed from space-axis stabilization, achieved by computer processing of signals from inertial sensors, to ship-axis stabilization. The gantry geometry is closed up as illustrated in FIG. 9*h*, and rotated as shown in FIG. 9*j* to a position as in FIG. 6 whereby the caliper 34 holds the target 10 in a substantially horizontal position such that the cylindrical portion 17 lies parallel to and can be engaged by clamp 44. It will be noted that the tag line 11 and the transfer hose line 9 extend away from the target 10, the running shackle 24 having rotated such that the coupling rod 25 aligns with the clamp 43 by which it will be engaged when the target engages clamp 44. At this stage, the ball end 26 (see also FIG. 5) can be caused automatically to engage the force sensitive mechanical coupling 21 on the winching equipment 16, by sliding action of a carriage 46, the coupling being then held by a clamp 45 and attached to the end of a line 47 wound on a winding drum 48. The caliper 34 then releases the target 10 and with the clamps 43 and 45 disengaged, the winch operated transfer hose line 9 will draw the hose 3 up to the deck until the fluid coupling 8 automatically engages the fluid inlet on the vessel and connects therewith so that fluid transfer can then be effected.

Figure 9K:
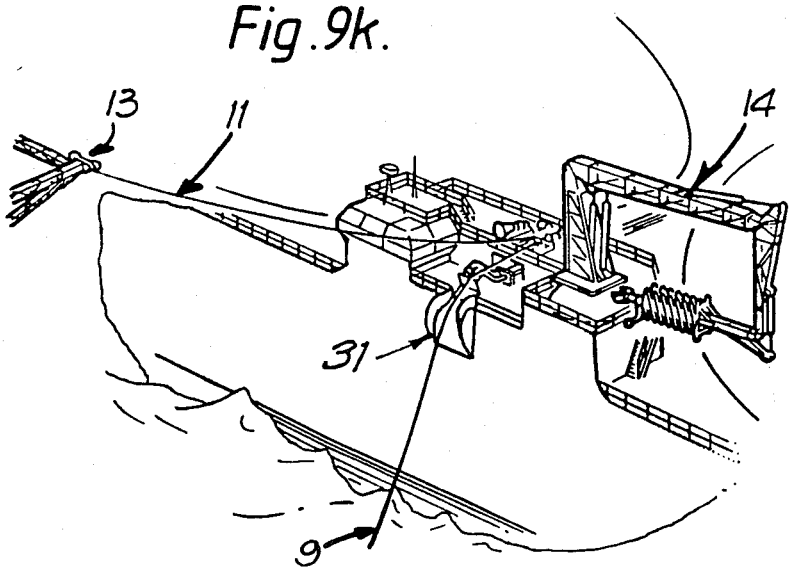

After disengagement of the caliper 34 from the target 10, held by clamp 44, the gantry is rotated and parked as indicated in FIG. 9*k*. It will readily be visualized from the above that at any stage of the capture and fluid transfer operations, the connection between the buoy and the receiver vessel can be voluntarily broken by releasing either the caliper 34, before target engagement with the deck equipment 16, or by releasing the clamps 43 and 45, after target clamping with the deck equipment 16. This permits the excess transfer hose line aboard the receiver vessel to pay out freely, allowing the hose, the transfer hose line and the tag line all to remain properly connected while they fall away from the receiver vessel. This enables rapid separation to be effected between the buoy and the receiver vessel for reasons of safety in an emergency situation which might otherwise entail considerable hazard to either the buoy or the receiving vessel or both.

Routine uncoupling after completion of the fluid transfer phase is achieved by permitting the hose and transfer hose line to pay out overboard in a controlled manner until the force sensitive mechanical coupling is disengaged by reverse movement of the carriage 46. The gantry is then programmed to re-engage with the target still held in clamp 44, which is then released and the gantry is activated to carry the target away from the receiver vessel towards the buoy to a position where it may safely be released from the calipers to settle beneath the buoy jib in position ready for the next transfer operation.

The gantry is then programmed to return inboard to the receiver vessel and is parked as shown in FIG. 9(*k*).

The operation of the fluid transfer system will now be described by way of summary with reference to the sequence of drawings 9*a*–9*h*, 9*j* and 9*k*.

Stage 1—Positioning (FIG. 9*a*)

At the commencement of the Hose Pick-up operation it is assumed that Skydrant 14 is parked in the stowed position with all systems de-activated. The ship 1 will be stationery at a position between 22 mm and 30 m from the buoy 2 and with Skydrant 14 located at ±5 m from the center-line of the buoy 2 in a fore and aft direction.

Stage 2—Deployment and Stabilisation (FIG. 9*b*)

Skydrant 14 is deployed by rotating the whole crane assembly on its slewing ring 41 until the booms are normal to the ship's fore and aft axis. Gantry boom members 35, 36 and 37 are then operated in sequence to a defined programme which gives the required geometry—a boom extension of approximately 20 m from Skydrant 14 with the outer boom 37 horizontal in the nominal zero ship motion condition. This minimum extension maintains Skydrant 14 in a position which ensures that a collision cannot take place even if the worst specified combination of ship/buoy movements takes place with the ship 1 and buoy 2 at minimum separation—22 meters.

When Skydrant 14 has been deployed, the control system is activated to stabilize the unit against all ship motions except in the lateral axis.

Stage 3—Boom Deployment (FIG. 9*c*)

With Skydrant 14 deployed and stabilized, the sensing devices 39 are activated but does not at this stage input to the stabilizing network. The sensor's function is to view the target markers 13 on the jib head 7, and to provide information on the relative motion between Skydrant 14 and buoy 2. These data are processed during a period of approximately ten minutes to assess the effect of the ship location system (not shown) and modify the Skydrant 14 position accordingly.

Stage 4—Boom Extension (FIG. 9*d*)

With the boom deployed, the ship motion lateral compensation system is activated and information from the sensing devices 39 is fed into the stabilizing network. Skydrant is now controlled in the vertical and fore and aft directions relative to the target on the buoy tag line. In the lateral mode the outer boom extends to the previously determined datum position, with lateral authority increasing from zero to 100% as the boom deploys to the datum setting. The Skydrant calipers are now maintained in nominal contact with the target, thereby enabling capture to be effected.

Stage 5—Target Capture (FIG. 9*e*)

Closure of the calipers around the target can either be achieved manually or automatically.

Stage 6—Boom Closure (FIG. 9*f*)

Once the target 10 is captured, the outer boom 37 retracts to its minimum extension pulling the tag 11 with it. During this operation, lateral compensation is progressively cancelled. Stabilization is also cancelled and Skydrant acquires ship motion.

Stage 7—Boom Retraction (FIG. 9*g*)

During the next stage of the operation the booms start to fold according to a pre-programmed sequence. This action pulls the target 10, the tag, line 11 and the transfer hose line 9 towards the ship 1.

Stage 8—Boom Alignment (FIG. 9*h*)

Folding continues until the center 36 and inner booms 35 have taken up a configuration similar to that adopted at the start of the capture sequence. Now, however, the outer boom 37 is programmed to change to a configuration in which it is hanging vertically downwards in preparation for placing the target on the ships deck.

Stage 9—Placing Target (FIG. 9*j*)

Skydrant 14 now swings in towards the ship 1 by rotating on its slewing ring 41. Having positioned the target 10 above the deck clamp 44, the outer boom 37 extends to place the target 10 at the required location. Once the deck clamp 44 has captured the target 10, the calipers 34 are released and the outer boom 37 retracts.

Stage 10—Stowing (FIG. 9*k*)

With the target 10 secured in the deck clamp 44, Skydrant 14 rotates to its parked position and folds in a predetermined sequence to the stowed configuration. Skydrant 14 remained stowed until the fluid transfer operation is completed, when it is re-activated to replace the target 10 in proximity to the buoy jib; this procedure is essentially a reversal of the sequence described.

We Claim:

1. An improved system for effecting open-sea transfer of fluid from a source, such as a moored or anchored oil or gas platform, vessel, buoy or wellhead, subject to wave action to a receiver vessel in open-sea conditions includes:

mounted on the receiver vessel a first self-sealing part of a connection means by which fluid may be transferred to the receiver vessel and gantry means movable in both elevation and azimuth; and mounted on the source; hose means having one end thereof connected to the source for the transfer of fluid therefrom and a second self-sealing part of the connection means connected to the other end of the hose means for engaging and automatically mating with the first self-sealing part of the connection means to form a continuous fluid path between the source and the receiver vessel;

wherein the improvement comprises:

means for at least partially space stabilizing the gantry means;

clamping means adjacent said gantry means;

target position sensing and acquisition means on said gantry means;

and vessel-mounted winding means adjacent the gantry means; and wherein mounted on the source are:

a transfer hose line having one end thereof secured to the other end of the hose means;

a target device secured to the other end of the transfer hose line such that the transfer hose line may be pulled through the target device when acquired by the acquisition means; and tag line means secured at one end to the target device and extendably secured at the other end to the source, whereby in use with the receiver vessel positioned adjacent the source, the gantry means may be at least partially space-stabilized, the target position sensing and acquisition means on the partially space stabilized gantry means may be aligned with the target device, such that the target device may be acquired by the target position sensing and acquisition means, the gantry means may be actuated so as to cause engagement between the target device and the clamping means, the other end of the transfer hose line may be connected to the winding means and the winding means may draw in the transfer hose line and thereby the hose until the first and second parts of the connection means engage and automatically mate to provide the continuous fluid path therebetween and to couple the hose to the receiver vessel, and whereby the hose may be uncoupled from the receiver vessel in a procedure substantially the reverse of the procedure recited above for coupling the hose to the receiver vessel.

2. A system for effecting open-sea transfer of fluid as claimed in claim 1 and further including connecting means for automatically connecting the other end of the transfer hose line to the winding means whenever the target device is engaged by the clamping means and for releasing the other end of the transfer hose line from the winding means whenever the load exerted on the connecting means, whether by design or accident, exceeds a predetermined magnitude.

3. A system for effecting open-sea transfer of fluid as claimed in claim 2 and wherein the connecting means is a force sensitive mechanical coupling.

4. A system for effecting open-sea transfer of fluid as claimed in claim 1 and wherein the at least partially space-stabilized gantry means has at least two articulated boom sections each independently movable in elevation with respect to other sections and an outer one of said boom sections is extendable in length and the target position sensing and acquisition means includes acquiring means carried at the end of the outer boom section.

5. A system for effecting open-sea transfer of fluid as claimed in claim 4 and wherein the acquiring means is carried on a rotary joint on the outer boom section.

6. A system for effecting open-sea transfer of fluid as claimed in claim 1 and wherein the gantry means is initially during a target device seeking phase space-stabilized by a system of inertial sensors and hydraulic actuators so that in use the target position sensing and acquisition means may maintain a constant position in space independent of pitch, roll, yaw, heave and sway movements of the receiver vessel but follows all non-transient movements of the receiver vessel in the for and aft direction but following target device sensing, i.e. whenever the target position sensing and acquisition means responds to the position of the target device, the gantry is no longer space stabilized but is controlled to follow movements of the target device.

7. A system for effecting open-sea transfer of fluid as claimed in claim 1 and further including indicating means mounted on the source 50 that in a target acquisition phase of the use of the system the indicating means is at a known position relative to the target and thereby facilitates target acquisition.

8. A system for effecting open sea transfer of fluid as claimed in claim 7 and wherein said indicating means comprises at least one target marker located on the source such as to be a predetermined distance above the target device whenever the target device is in a stowed position and the target position sensing and acquisition means comprises at least one television camera and an acquisition means below at least one television camera mounted on the gantry means separated by substantially said predetermined distance.

9. A system for effecting open-sea transfer of fluid claim 1 and wherein said hose means is carried in a buoy in communication with a fluid supply source, said buoy including a jib structure from which the hose means and the tag line means separately depend in looped fashion, said tag line means being housed within the buoy to allow appropriate extension when said target device is acquired and carried towards the receiver vessel by the gantry means.

* * * * *